US006725629B2

(12) United States Patent
Pearce et al.

(10) Patent No.: US 6,725,629 B2
(45) Date of Patent: Apr. 27, 2004

(54) HORIZONTAL CARTONER SYSTEM AND METHOD FOR THE USE THEREOF

(75) Inventors: Larry N. Pearce, Oak Park, IL (US); Vadim A. Lubezny, Buffalo Grove, IL (US)

(73) Assignee: Triangle Package Machinery Company, Chicago, IL (US)

( * ) Notice: Subject to any disclaimer, the term of this patent is extended or adjusted under 35 U.S.C. 154(b) by 0 days.

(21) Appl. No.: 10/121,079

(22) Filed: Apr. 12, 2002

(65) Prior Publication Data

US 2002/0170271 A1 Nov. 21, 2002

Related U.S. Application Data

(60) Provisional application No. 60/286,786, filed on Apr. 26, 2001.

(51) Int. Cl.[7] ..... B65B 5/04

(52) U.S. Cl. ..... 53/473; 53/566; 53/239; 53/251; 53/284.5

(58) Field of Search ..... 53/566, 473, 475, 53/239, 240, 251, 284.5, 245

(56) References Cited

U.S. PATENT DOCUMENTS

| | | | |
|---|---|---|---|
| 1,926,060 | A | 9/1933 | Peters |
| 3,102,374 | A | 9/1963 | Lloyd et al. |
| 3,486,296 | A | 12/1969 | Hechenleitner |
| 3,710,543 | A | 1/1973 | Toss |
| 3,766,706 | A | 10/1973 | Graham |
| 3,774,509 | A | 11/1973 | Heinzer |
| 3,815,321 | A | 6/1974 | Hartman |
| 3,941,037 | A | 3/1976 | Reichert |
| 3,983,682 | A | 10/1976 | Scully |
| 4,104,847 | A | 8/1978 | Glandon et al. |
| 4,144,694 | A | 3/1979 | Stapp et al. |
| 4,192,121 | A | 3/1980 | Caudle |
| 4,215,520 | A | 8/1980 | Heinzer et al. |
| 4,358,918 | A | 11/1982 | Groom et al. |
| 4,524,566 | A | 6/1985 | Hauers et al. |

(List continued on next page.)

OTHER PUBLICATIONS

Preliminary sketches and CAD models of horizontal intermittent motion bag–in–box system, pp. 1–5, dated prior to Apr. 26, 2000.

Letter from Triangle Package Machinery Company to potential customer, dated prior to Apr. 26, 2000.

"Excellence in Fully Intregrated Horizontal Systems", *Triangle Yeaman Cartoners*.

"Excellence in Fully Integrated Vertical Systems", *Triangle Yeaman Cartoners*.

*Primary Examiner*—Stephen F. Gerrity
*Assistant Examiner*—Hemant M. Desai
(74) *Attorney, Agent, or Firm*—Brinks Hofer Gilson & Lione

(57) ABSTRACT

A cartoner assembly comprises a loader and an indexer. The loader comprises at least one horizontally extending drive belt, an input end and an output end. The drive belt is adapted to support one or more packages as they are moved from the input end to the output end. The indexer is positioned adjacent the output end of the loader and comprises a plurality of moveable support members defining in part a plurality of loading stations. The support members are adapted to support a carton at each of the loading stations and are moveable such that the plurality of loading stations are successively aligned with the drive belt of the loader at the output end of said loader. Preferably, the support members are vertically, intermittently moveable. In one preferred embodiment, the indexer includes an output end positioned adjacent a continuously moving conveyor. A method of inserting a package into a carton is also provided.

27 Claims, 10 Drawing Sheets

U.S. PATENT DOCUMENTS 4,537,008 A 8/1985 Benz
4,545,183 A 10/1985 Stohlquist et al.
4,558,779 A 12/1985 Schmitt et al.
4,571,236 A * 2/1986 Adams ..... 493/319
4,571,926 A 2/1986 Scully
4,608,808 A 9/1986 Ryan et al.
4,633,651 A * 1/1987 Edmunds ..... 53/435
4,633,653 A * 1/1987 Roberts et al. ..... 53/498
4,662,152 A 5/1987 Simelunas et al.
4,750,315 A 6/1988 Wadell
4,800,703 A 1/1989 Goodman
4,807,741 A 2/1989 Simelunas et al.
4,815,253 A 3/1989 Kovacs et al.
4,856,566 A 8/1989 Tisma
4,891,928 A 1/1990 James et al.
4,924,656 A 5/1990 Kovacs et al.
4,938,003 A 7/1990 Seppala
4,955,929 A 9/1990 Klapp
4,979,353 A 12/1990 Seppala
5,010,929 A 4/1991 Tisma
5,012,628 A 5/1991 Van Oord
5,058,634 A 10/1991 Tisma
5,170,610 A 12/1992 Tisma
5,185,984 A 2/1993 Tisma
5,235,796 A 8/1993 Campbell, III et al.
5,241,806 A * 9/1993 Ziegler et al. ..... 53/566
5,251,422 A 10/1993 Goodman et al.
5,343,671 A 9/1994 Tisma
5,347,796 A * 9/1994 Ziegler et al. ..... 53/566
5,371,995 A 12/1994 Guttinger et al.
5,388,389 A 2/1995 Tisma
5,460,258 A 10/1995 Tisma
5,488,815 A * 2/1996 Abrams et al. ..... 53/425
5,560,184 A 10/1996 Tisma
5,657,610 A 8/1997 Dietrich et al.
5,727,365 A * 3/1998 Lashyro et al. ..... 53/448
5,787,680 A * 8/1998 Tisma et al. ..... 53/244
5,855,105 A * 1/1999 Ferris ..... 53/475
6,574,943 B2 * 6/2003 Van Dam ..... 53/447

* cited by examiner

HORIZONTAL CARTONER SYSTEM AND METHOD FOR THE USE THEREOF

This application claims the benefit of U.S. Provisional Application No. 60/286,786, filed Apr. 26, 2001, the entire disclosure of which is hereby incorporated herein by reference.

BACKGROUND

The present invention relates generally to cartoners or cartoner machines, and in particular, to horizontal cartoners.

Cartoners, or cartoner machines, typically are designed to insert a material or substance, or a package of material or substance, into a carton. For example, the cartoner machine may be configured to open or unfold a carton, insert the material or package into the carton and thereafter close the carton. Cartoners generally are designed to fill and close a large number of cartons in a relatively short period of time, and are typically incorporated into an assembly line. As such, it is important to minimize the amount of time required to fill and close the carton, while at the same time minimizing the number of malfunctions, including for example jamming, breaking or otherwise damaging the package and/or carton, which can lead to downtime of the machine.

Typically, cartoners are configured as vertical cartoners or horizontal cartoners. Vertical cartoners typically insert a material or package of material vertically into a carton having an upwardly facing open end. In this way, gravity assists in the insertion and/or filling process. Typically, the cartons are intermittently conveyed or moved beneath a filling station, at which the carton is filled.

Horizontal cartoners typically insert a package of material horizontally into a carton, which typically is configured with an open end that faces sideways. Often, horizontal cartoners include a series of trays, which are shaped to hold the package (usually on three sides), and a series of push members, which gradually push the package horizontally from the tray into a carton as the tray and push members move together along the assembly line. Often, when the packages hold a fluid substance, such as a liquid or powder, the packages can be difficult to insert into the carton. Moreover, the speed of the overall process line is often limited by the rate at which the cartons are filled. In addition, when a malfunction, such as a jam, occurs at any one of the tray/pusher stations, the entire line may need to be shut down, thereby decreasing the overall efficiency of the system.

SUMMARY

Briefly stated, in one aspect, the invention is directed to a horizontal cartoner assembly, which inserts a package into a carton. In one preferred embodiment, the cartoner assembly comprises a loader and an indexer. The loader comprises at least one horizontally extending drive belt, an input end and an output end. The drive belt is adapted to support one or more packages as they are moved from the input end to the output end. The indexer is positioned adjacent the output end of the loader and comprises a plurality of moveable support members defining at least in part a plurality of loading stations. The support members are adapted to support a carton at each of the loading stations and are moveable such that the plurality of loading stations are successively aligned with the drive belt of the loader at the output end of the loader. In a preferred embodiment, the drive belt moves at a constant speed, while in other preferred embodiments it is accelerated.

In one preferred embodiment, the loader comprises a first, second, third and fourth drive belt, with the first and second drive belts spaced from each other in a substantially parallel relationship, with the third and fourth drive belts spaced from each other in a substantially parallel relationship and with the third and fourth drive belts oriented in a substantially perpendicular relationship to the first and second drive belts, wherein the space between the first and second drive belts can be varied. In one preferred embodiment, at least one of the first and second drive belts is moveable toward and away from the other of the first and second drive belts. Also in one preferred embodiment, at least one of the third and fourth drive belts is moveable toward and away from the other of the third and fourth drive belts, wherein the space between the third and fourth drive belts can be varied.

In one preferred embodiment, the indexer comprises first and second spaced apart drive members, with each of the first and second drive members having a plurality of support members extending therefrom. In one preferred embodiment, the indexer further includes third and fourth spaced apart drive members, each having a plurality of support members extending therefrom. The support members on the first, second, third and fourth drive members preferably define the plurality of loading stations.

In another aspect of the invention, the cartoner further comprises a conveyor positioned adjacent an output end of the indexer. In one preferred embodiment, the conveyor is continuously moveable, while in another embodiment it is configured to be intermittently moveable. The indexer releases the carton with the package inserted therein onto the conveyor. In one preferred embodiment, a plurality of loaders and associated indexers are successively aligned adjacent the conveyor.

In yet another aspect of the invention, a carton placer is positioned adjacent an input end of the indexer and is adapted to position a carton in each of the plurality of loading stations. In a preferred embodiment, the carton placer is a rotary carton placer.

In another aspect of the invention, a method of inserting a package into a carton comprises moving the package along a horizontal path, moving a carton into alignment with the horizontal path, wherein the carton comprises at least one open end, stopping the carton when the open end of the carton is aligned with the horizontal path, inserting the package into the carton through the open end of the carton, and moving the carton with the package inserted therein away from the horizontal path. In a preferred embodiment, the package is moved along the horizontal path at a constant speed.

In a preferred embodiment, the carton is moved along a vertical path into alignment with the horizontal path, and is moved along a vertical path as it is moved away from the horizontal path.

In another aspect of the invention, the method further includes inserting a premium into the carton.

In yet another aspect, the method further includes depositing the carton with the package inserted therein onto a conveyor and thereafter closing the open end of the carton. In one preferred embodiment, the conveyor is continuously moving, while in another it moves intermittently.

In one preferred embodiment, a first carton is deposited onto the conveyor at a first location fixed relative to the moving conveyor and a second carton is deposited onto the conveyor at a second location fixed relative to the moving conveyor, wherein the second location is positioned downstream of the first location.

In one preferred embodiment, a plurality of packages are moved along the horizontal path at a constant speed, wherein the plurality of packages are spaced apart along the horizontal path. Also in one preferred embodiment, the method includes successively, intermittently moving a plurality of cartons into alignment with the horizontal path. In one alternative preferred embodiment, a plurality of packages can be moved together along the horizontal path and can be inserted into a single carton.

The present invention provides significant advantages over other cartoners. For example, the indexer, which is preferably intermittent, can feed cartons with packages inserted therein into a continuous closer. As such, the closer can be run more efficiently, without interrupting various closing operations, such as gluing the package, even when one or more of the loader, indexer, or carton placer jams or otherwise malfunctions. In addition, a plurality of indexers can be fed into a single closer. Therefore, if one or more indexers, or associated loaders, jams or otherwise malfunctions, the remaining indexers and loaders can continue to feed the closer, such that the entire operation is not shut down.

Likewise, the assembly can be provided with multiple package feeds feeding into a single loader. Again, if a problem develops with one or more of those feeds, the remaining feeds and loader can continue to supply the indexer and, subsequently, the closer. In addition, the cartoner is ideally suited for the insertion of premiums and coupons, which can be inserted into the carton either before or after the package is inserted into the carton.

The loader by itself also provides significant advantages. By providing a loader that operates at a constant speed or velocity, the package is maintained in a relative uniform shape, and is not otherwise deformed or acted upon by acceleration forces. At the same time, the package can be quickly inserted into the carton, which is preferably stationary, without applying excessive forces to the opposite end of the carton, and without the protracted manipulation of a pusher member. At the same time, the loader and indexer can be made relatively compact, such that they typically require less floor space than a conventional horizontal push-member cartoner. In addition, the loader and indexer are very accessible to the operation, thereby facilitating the clearing of jams and the like.

In addition, in one preferred configuration of the loader, which includes at least four drive belts, the loader shapes and maintains the shape of the package such that it is shaped to be easily received in the carton, even when the package contains fluid-like substances. Moreover, in a preferred embodiment, the space between opposing drive belts can be easily changed to accommodate different packages having different depths and widths. Likewise, the spacing between the support members and drive members on the indexer can be easily changed to accommodate cartons having different depths and widths. As such, changeover from one product to another is greatly simplified, and avoids the need to replace trays and pusher members of different sizes, which can be very time consuming. In this way, the downtime of the line can be greatly reduced between product changeovers.

The present invention, together with further objects and advantages, will be best understood by reference to the following detailed description taken in conjunction with the accompanying drawings.

DETAILED DESCRIPTION OF THE PRESENTLY PREFERRED EMBODIMENTS

It should be understood that the term "plurality," as used herein, means two or more. The term "carton," as used herein, means any box, bottle, bag, tube, canister, sleeve, pouch, packet or other container, whether rigid or flexible and whether made of cardboard, metal, paper, foil, plastic or any other known and suitable material, capable of holding a substance, or a package containing a substance. The term "package," as used herein, means any box, bottle, bag, tube, canister, sleeve, pouch, packet or other container, whether rigid or flexible and whether made of cardboard, paper, foil, plastic or any other known and suitable material, capable of holding a substance. The term "substance," as used herein, means any liquid, solid, powder, flake, or other like material, including for example and without limitation, various food stuffs, including for example and without limitation, various grains, powders, cereals, liquids, crackers, bars, flakes, vegetables (raw and individually quick frozen), meat, poultry, potato products (including for example french fries) and like materials that are typically packaged for sale to and use by consumers. The term "longitudinal," as used herein means of or relating to length or the lengthwise direction, and in general corresponds to the machine direction. The term "lateral," as used herein, means situated on, directed toward or running from side to side, and in general corresponds to the cross-machine direction.

Figure 9:
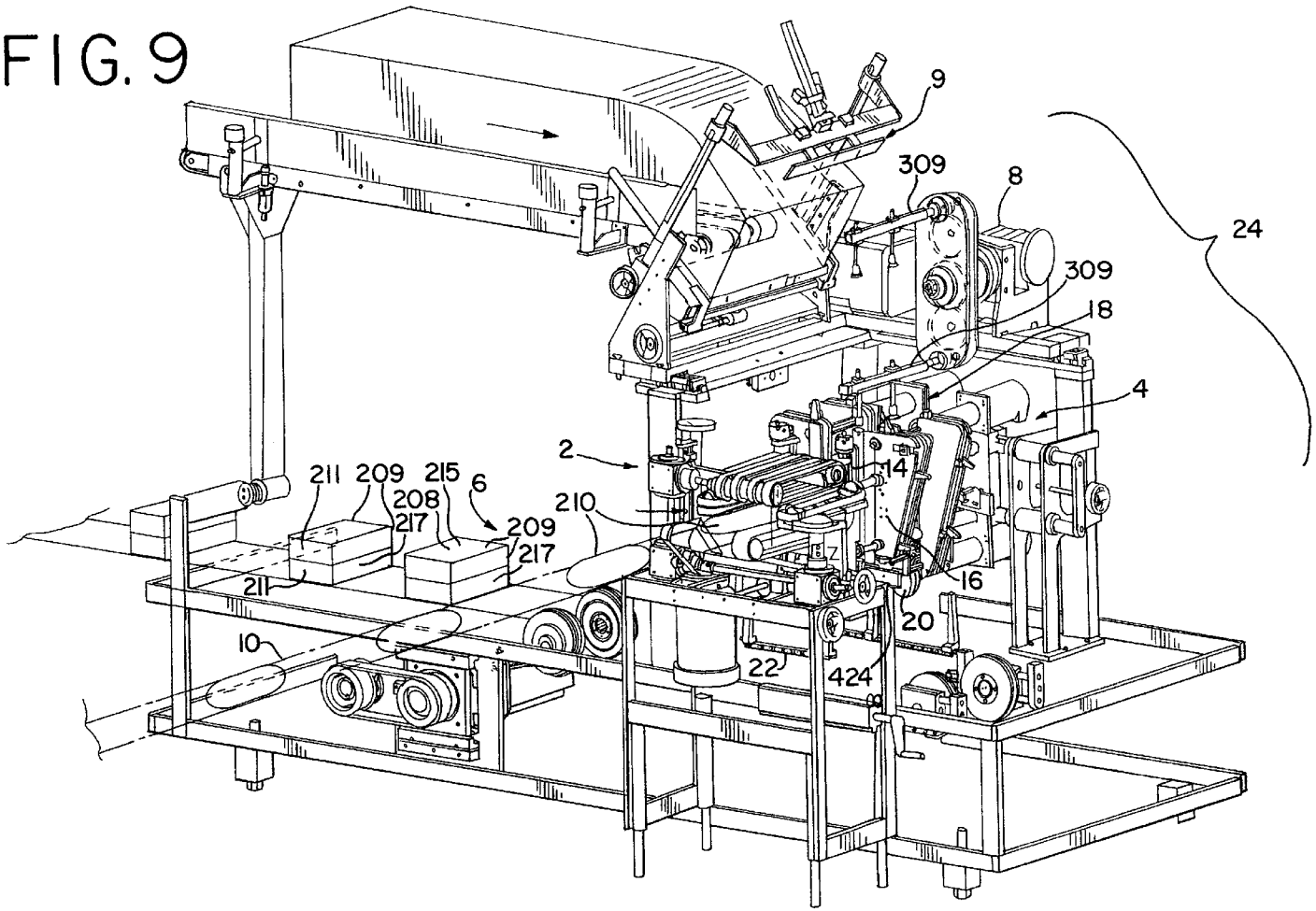
FIG. 9 is a perspective view of a horizontal cartoner assembly.
Figure 10:
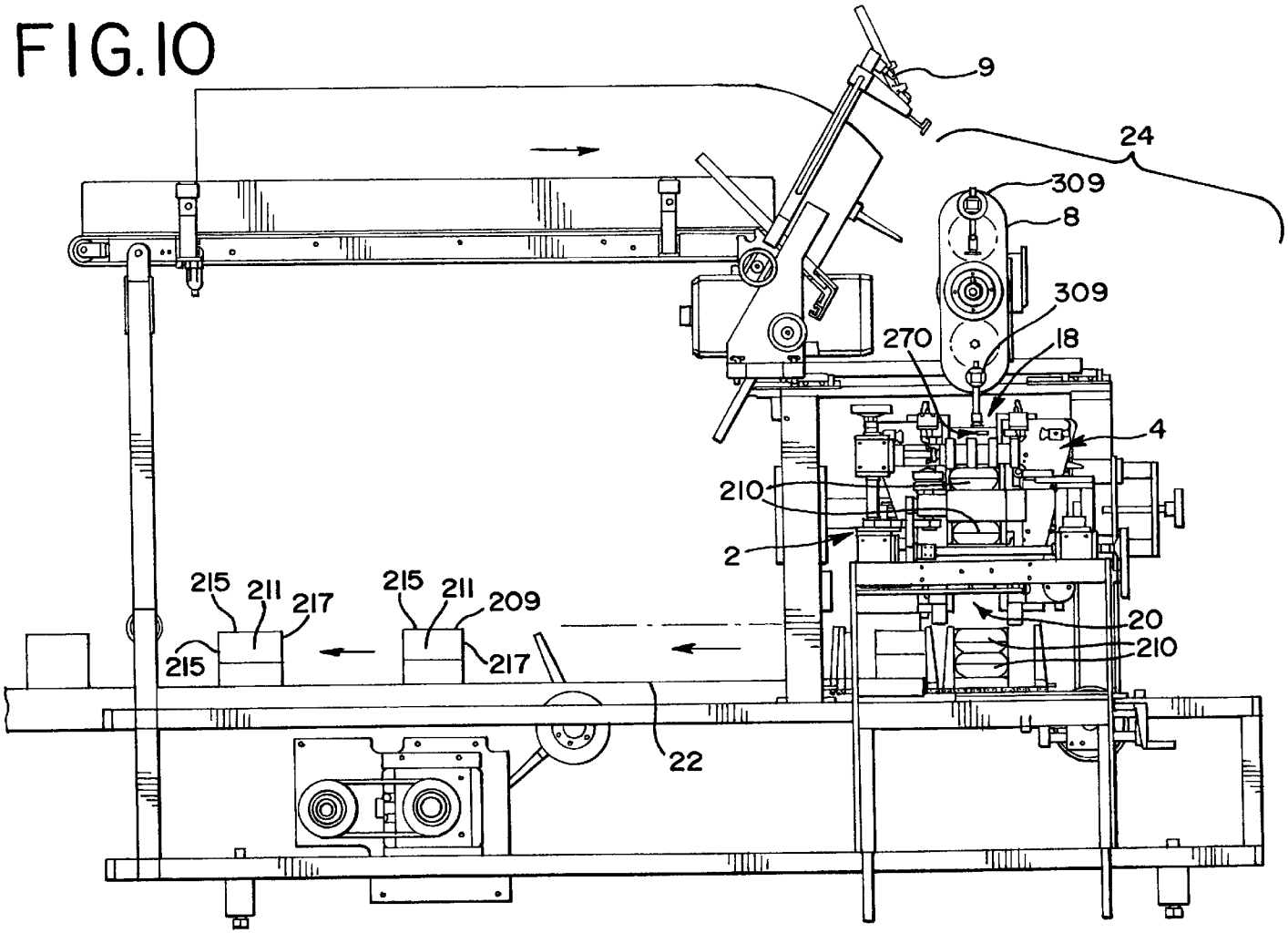
FIG. 10 is a side view of the horizontal cartoner assembly shown in FIG. 9.

Referring to FIGS. 9 and 10, the cartoner assembly includes a loader 2, an indexer 4, a closer 6, a horizontal carton placer 8, a carton magazine 9 and one or more package feeds 10. The package feeds 10 are positioned adjacent to and feed into an input end 12 of the loader. A loading side 16 of the indexer is positioned adjacent an output end 14 of the loader, with an opposite backstop side 17 positioned away from the output end of the loader. The carton placer is positioned adjacent an input end 18 of the indexer. An output end 20 of the indexer is positioned adjacent a conveyor 22, which feeds into and forms part of the closer section. It should be understood that a plurality of indexers, associated loaders and associated carton placers, the combination of which form and define a plurality of loading cells 24, can be installed at various fixed locations relative to a single conveyor. For example, two loading cells, located for example at a first and second position could be used to supply the conveyor. In the same vein, one or more package feeds can feed a single loader. It should be understood that the packages are filled with a substance at a filling station positioned upstream of the package feeds, and that such filling stations are well known in the art and are not further shown or described for the purposes of this invention. Likewise, many conventional closers are well known in the art and are suitable for closing and gluing various carton flaps after the carton with the package therein is deposited onto the conveyor, and are not further shown or described for the purposes of this invention.

Referring to FIGS. 1–4, the loader comprises a lower drive assembly 26, which includes a horizontally, and longitudinally extending first drive belt 28 supported by rollers or pulleys at opposite ends thereof. A vacuum can be applied through the drive belt, and in particular through the upper, outer surface 66 thereof so to help locate the package on and hold it to the belt 28. It should be understood that a plurality of first drive belts could be arranged in a side-by-side relationship. It also should be understood that the term "belt" as used herein means any looped member, whether made of canvas, fabric, chain, rubber or other suitable material. A secondary horizontally and longitudinally extending first drive belt 30 is positioned alongside the primary first drive belt 28 and includes an outer support surface substantially flush with the outer surface 66 of the drive belt 28. The secondary first drive belt 30 can be removed to accommodate smaller packages having a lesser lateral extent, or secured to the primary first drive belt with an extension to accommodate larger packages having a larger lateral extent.

A pulley 32 is mounted on the end of a shaft 34 connected to the roller at the input end of the loader. A belt 36 is connected to the pulley 32 and extends to and is connected with a pulley 38 mounted on a shaft 40 extending between a pair of lower gear boxes 42, 44 mounted on opposite sides of the loader. Preferably the pulleys and belt are configured with teeth in a timing-belt configuration. A shaft 46 extends from the bottom of the left side gear box 42 and is operably connected to a motor 50 with a belt 48 and a pair of pulleys 52, 54, all of which again are preferably configured with teeth. The motor is preferably ¾ hp.

The loader is further configured with an upper drive assembly 56, which includes a plurality of horizontally and longitudinally extending second drive belts 58 arranged in a side-by-side arrangement. The drive belts 58 are supported by pulleys 60, 62 on opposite ends thereof, preferably all of which include intermeshing teeth. It should be understood that a single, preferably wider, second drive belt also could be used, or that some other plurality of belts could be used to accommodate packages having greater or lesser lateral extents. It also should be understood that although the upper drive assembly is configured with four drive belts, only three drive belts, or even one or two of the drive belts, may be engaged with a package if the space between an right and left drive assembly is reduced to accommodate a package having a lesser lateral extent.

The lower, outer surface 64 of the second drive belts, which are preferably relatively smooth, are spaced from an upper, outer surface 66 of the first drive belt in a substantially parallel relationship. The upper drive assembly is cantilevered outwardly from a support 68 in an overlying relationship with the lower drive assembly 26. A gear box 70 is connected to the support. A shaft 72 extends vertically between and operably connects the lower left gear boxes 42 and the upper gear box 70. The shaft extends through the gear box 70, such that the gear box can be slid up and down thereon. A shaft 74 extends laterally, horizontally outward from the gear box 70 and is operably connected to the pulleys at one end of the drive assembly. The shaft 74 can be configured as two axially aligned shafts connected with a coupling (not shown), or can be configured as a single shaft extending between the gear box and the pulleys.

The support 68 is moveably supported on a vertical support 78 that extends upwardly from a base 80 of the loader. Preferably, one or more linear bearings interface between the supports 68, 78. An actuator 74, shown as a threaded shaft 82, is rotatably mounted to the vertical support 78, and includes a wheel 84 connected to the upper end of the shaft. The shaft 82 threadably engages the support 68. In operation, the operator rotates the wheel 84 and shaft 82, thereby causing the support 68 to move up or down on and relative to the vertical support 78. In this way, the operator can adjust the space between the lower outer surface 64 of the upper second drive belts and the upper outer surface 66 of the lower first drive belt, for example to accommodate packages having different depths. It should be understood that the upper drive assembly 56 could be maintained in a fixed position, with the lower drive assembly being moveable, or that both drive assemblies can be made moveable relative to each other.

The loader further comprises left and right side drive assemblies 86, 88, one or both of which can be made moveable toward and away from the other thereof. The left side drive assembly 86 includes a pair of third drive belts 90 that are horizontally and longitudinally extending and that are oriented substantially perpendicular to the first and second drive belts 28, 58. It should be understood that a single belt, or more than two belts, could be used on the left drive assembly. For example, the upper third drive belt 90 can be removed to accommodate a smaller package having a lesser vertical extent as the space between the lower and upper drive assemblies is reduced. Conversely, an additional third drive belt can be added to accommodate a larger package. The third drive belts 90 are supported on opposite ends thereof by pulleys 92, 96, with the pulleys and belts preferably configured with teeth. A shaft 94 extends from and is operably connected to the pulley 92 positioned proximate the input end 12 of the loader. A belt 98 extends between and is operably connected to a pulley 102 connected to the shaft 94 and another pulley 100 connected to the shaft 72 extending between the gear boxes 42, 70. Preferably, the belt and pulleys 98, 100, 102 are configured with teeth. The left drive assembly is supported by the base.

The right drive assembly 88 includes a pair of fourth drive belts 104 extending horizontally and longitudinally between pulleys 106, 108 at opposite ends thereof. Again, it should be understood that a single belt, or more than two belts, could be used to accommodate packages of various sizes and dimensions. The belts 104 are oriented substantially perpendicular to the first and second drive belts, and include an inwardly facing, outer support surface 110 spaced from the outer support surface 112 of the third drive belts 40 in a parallel relationship. A belt 114 is operably connected with a pulley 116 on the input end of the drive belt. The belt 114 is connected to a second pulley 118 connected to an end of a shaft 120, which extends vertically from the right-side gear box 44 and which is covered with a cover 123. A cover 121 also preferably extends over the pulley and drive belt. The pulleys are supported on a support 122, which is horizontally, movably connected to a lower support 124. In one preferred embodiment, one or more linear bearings interface between the supports 122, 124. An actuator 126, including a threaded shaft 128 and wheel 130, is rotatably supported by the base 80. The shaft 128 threadably engages the lower support 124. In operation, the operator rotates the wheel 130 and shaft 128, thereby causing the right drive assembly to move horizontally toward and away from the left drive assembly, which in turn causes the inwardly facing outer surfaces 112, 110 of the third and fourth drive belts to move toward and away from each other. In this way, the space between the third and fourth drive belts can be adjusted to accommodate packages of different sizes and in particular different widths. It should be understood that the left drive assembly also can be made adjustable. The shaft 40 extends through the gear box 44, thereby allowing the gear box 44 to be slideably moved on the shaft 40 with the right drive assembly.

The entire drive assembly, including the upper, lower, right and left drive assemblies, also can be moved along a longitudinal, horizontal path, and along a vertical path. In particular, the base 80 is slideably supported on a support frame 132 with linear bearings 134. An actuator 134, including a shaft 136 and wheel 138 is rotatably supported on the support frame 132. An end of the shaft actuates a jack-screw 140. In operation, the wheel 138 and shaft 136 are rotated, which thereby causes the base 80 and drive assembly to move toward or away from the indexer 4. It should be understood that the support frame 132 could be configured with wheels, preferably lockable, such that the loader is easily portable from one location to another along the assembly line. In addition, the support frame 132 includes a plurality of lower support legs 142 that are adjustably connected to a plurality of upper support legs 144, and which are moveable relative to each other by way of an actuator 146. Preferably, the actuator 146 includes a hydraulic pump that is operably connected to each of the four support legs with a fluid conduit. The pump can be actuated to flow fluid to and from the legs through the conduits so as to raise and lower the support frame and loader. In this way, the entire drive assembly can be moved vertically so as to align the output end 14 of the loader with loading side 16 of the indexer, package feed or other piece of equipment.

The inwardly facing outer surfaces 64, 66, 110, 112 of the first, second, third and fourth drive belts define a space, preferably rectangular, shaped to receive one or more packages of substance. The drive belts 28, 58, 90, 104 propel the package(s) along a horizontal path while at the same time shaping the package(s) such that it is shaped to be received in a carton at the output end 14 of the loader. A vacuum can be applied to the package through or between any one or all of the drive belts. Since the first, second, third and fourth drive belts 28, 58, 90, 104 are operably connected by way of the various belts, pulleys, shafts and gear boxes, the drive belts are driven together at the same speed. In addition, a single motor 50 can be used to drive all of the drive belts. It should be understood that the gear boxes 42, 44, 70 can be configured with two or more beveled gears, or other known gearing arrangements, to connect the drive shafts 40, 72, 74, 104 extending perpendicularly therefrom. Alternatively, it should be understood that one or more stepper motors can be individually connected to each drive assembly, with the stepper motors operably connected to coordinate the action thereof.

In a preferred embodiment, the motor 50 and connected drive belts 28, 58, 90, 104 are run at a constant speed or velocity. Preferably, the connected drive belts are preferably run at a speed of from between about 0 feet per second (fps) to about 10 fps, and more preferably at a speed from about 2 fps to about 8 fps, and most preferably at a speed of about 5 fps. Of course, it should be understood that the drive belts can be run at other speeds greater than 10 fps depending on the application being run and the variables associated therewith, including for example the type of substance, package and carton.

It should be understood that the term "constant" refers to the speed at which the belts are run during and between the loading of at least two successive packages into two successive cartons, meaning that the belts are not accelerated or decelerated between the insertion of those at least two successive packages into the at least two successive cartons. In this way, it is understood that the loader can be periodically slowed down or sped up to accommodate jams or other necessary slow downs encountered during the normal operation of the cartoner, but that it is intended and desired to run continuously at one substantially constant speed. It should be understood that the loader also can be generally slowed down or sped up to accommodate different numbers and/or types of packages and/or substances being inserted into the cartons. Preferably, the packages are received by the loader at the input end 12 thereof at the same or lesser speed of the belts 28, 58, 90, 104. By running the belts at a constant speed, the packages are not deformed by acceleration, and the substance therein, including various pieces thereof, is moving at the same speed. Moreover, there is no need to successively speed up and slow down the belts, which can create excessive wear and complicate the control system for the loader. In addition, the coordination of the timing of the package feeder, loader and indexer is less critical.

It should be understood, however, that the system can be configured to receive a package at the input end and accelerate the package toward the output end, such that the speed of the package at the output end is greater than the speed of the package at the input end. For example, the package can be accelerated from 0 inches per second (ips) to between about 50 ips and 120 ips, and more preferably about 88 ips. Of course, it should be understood that the initial speed can be greater than 0 ips, and that the final speed can be greater or less than about 120 fps depending on the application. Preferably, the acceleration of the package is between about 0 inches/$s^2$ and about 386 inches/$s^2$, which is equal to 1 "g". Alternatively, the acceleration of the package can be up to 2 g's, or even more depending on the application.

By adjusting the height and longitudinal position of the output end 14 of the loader with actuators 146, 134 respectively, the space formed by the belts at the output end can be aligned with a loading station 144 defined and formed by the indexer 4. Preferably, the space formed by the belts is slightly smaller, with a slightly lesser depth and width, than the carton opening into which it is to be inserted. In an alternative embodiment, the upper drive assembly can be omitted, since three side constraints are adequate to shape the package. If the package is rigid, it may also be possible to omit the left and/or right drive assemblies.

Figure 2:
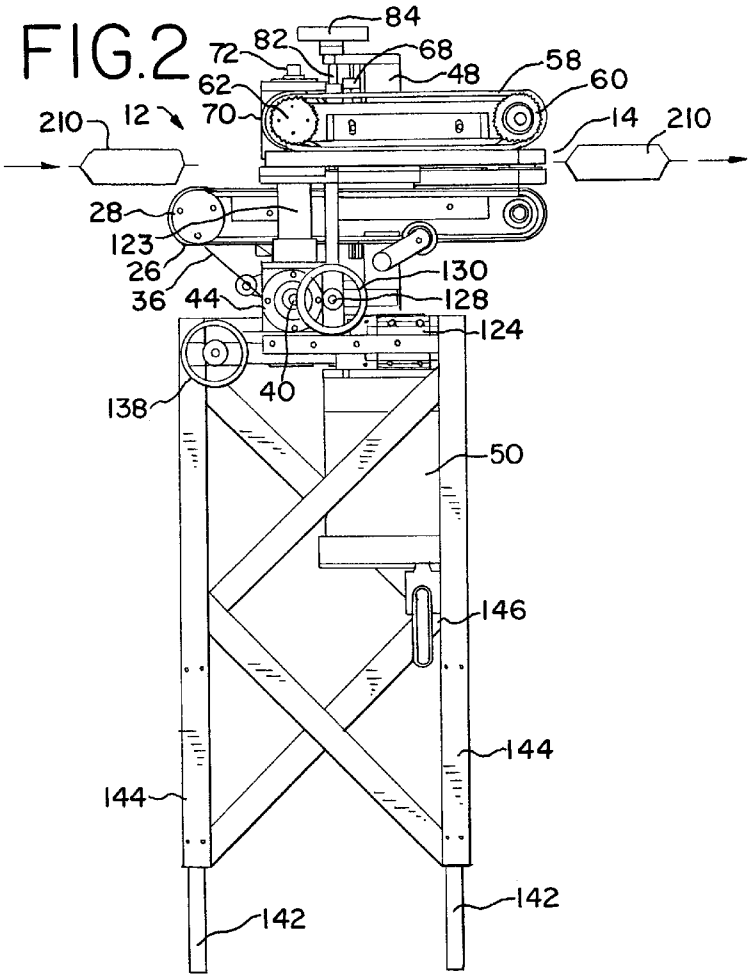
FIG. 2 is a side view of the loader.
Figure 1:
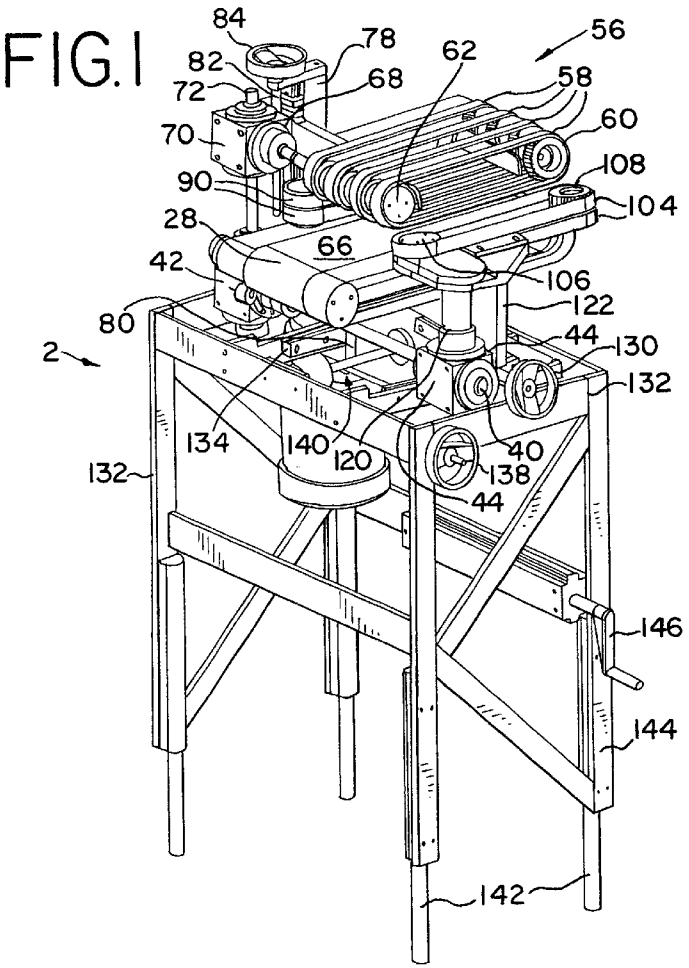
FIG. 1 is a perspective view of a loader.
Figure 4:
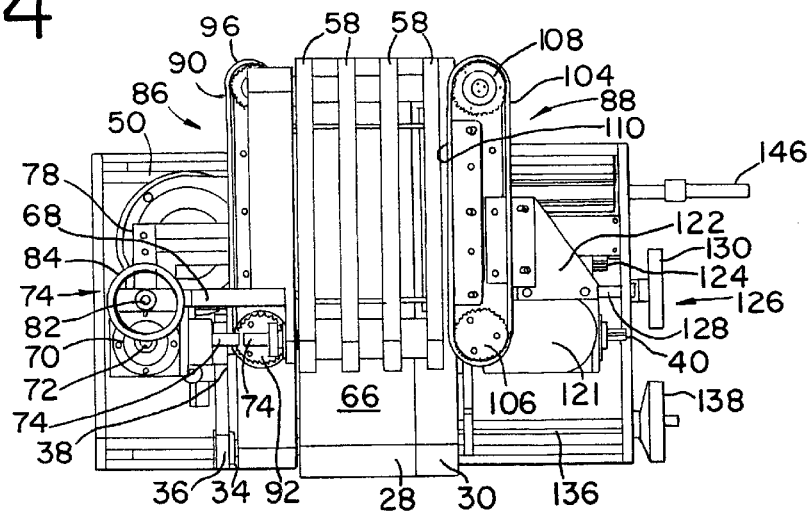
FIG. 4 is a top view of the loader.
Figure 3:
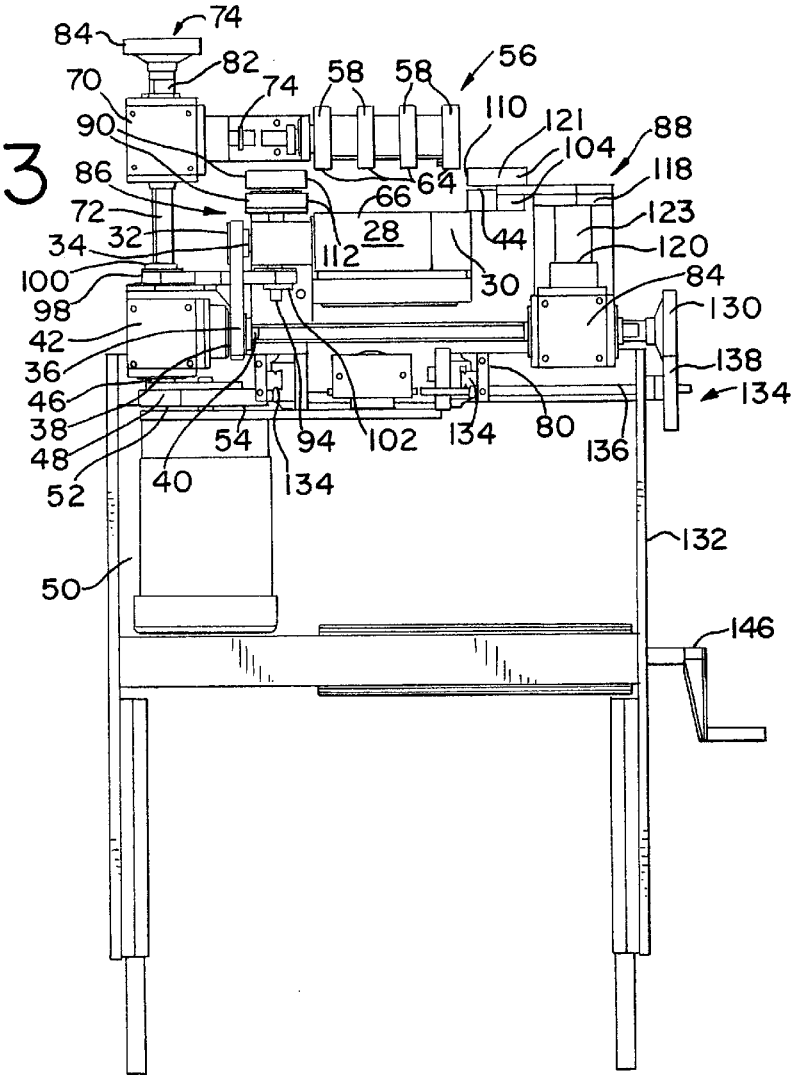
FIG. 3 is front view of the loader taken from the input end thereof.
Figure 5:
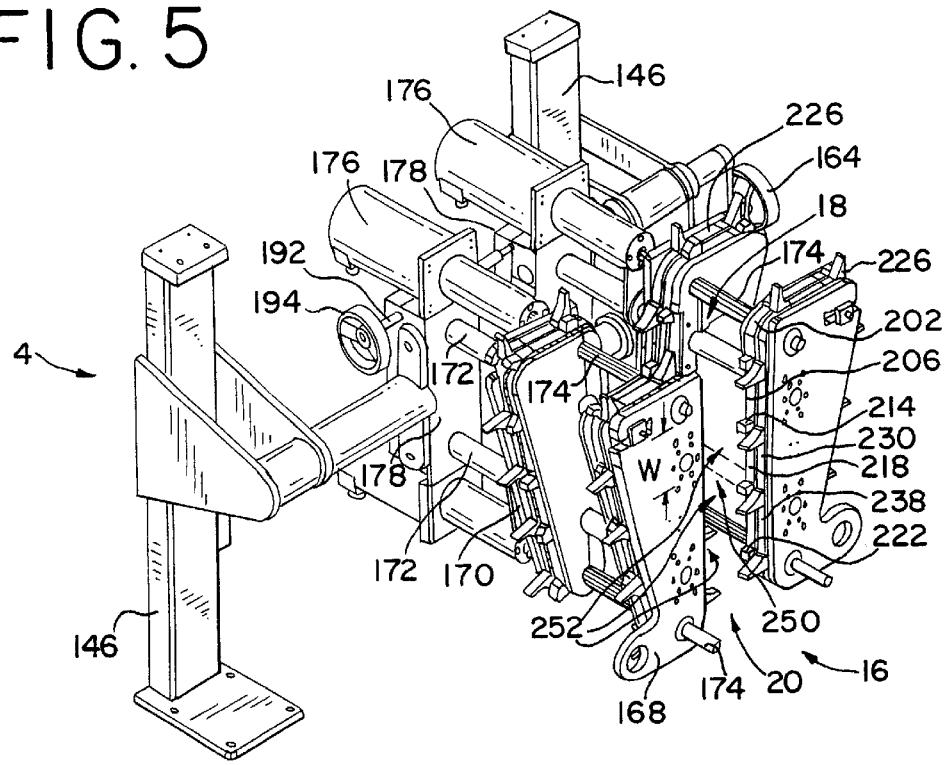
FIG. 5 is a left perspective view of the indexer taken from a loading side thereof.
Figure 6:
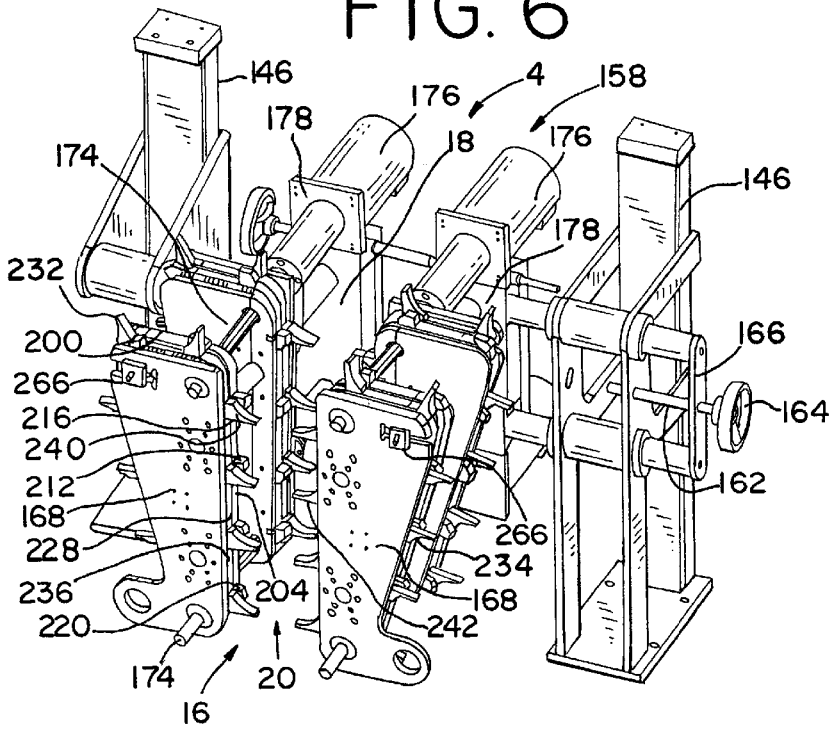
FIG. 6 is a right perspective view of the indexer taken from the loading side thereof.
Figure 7:
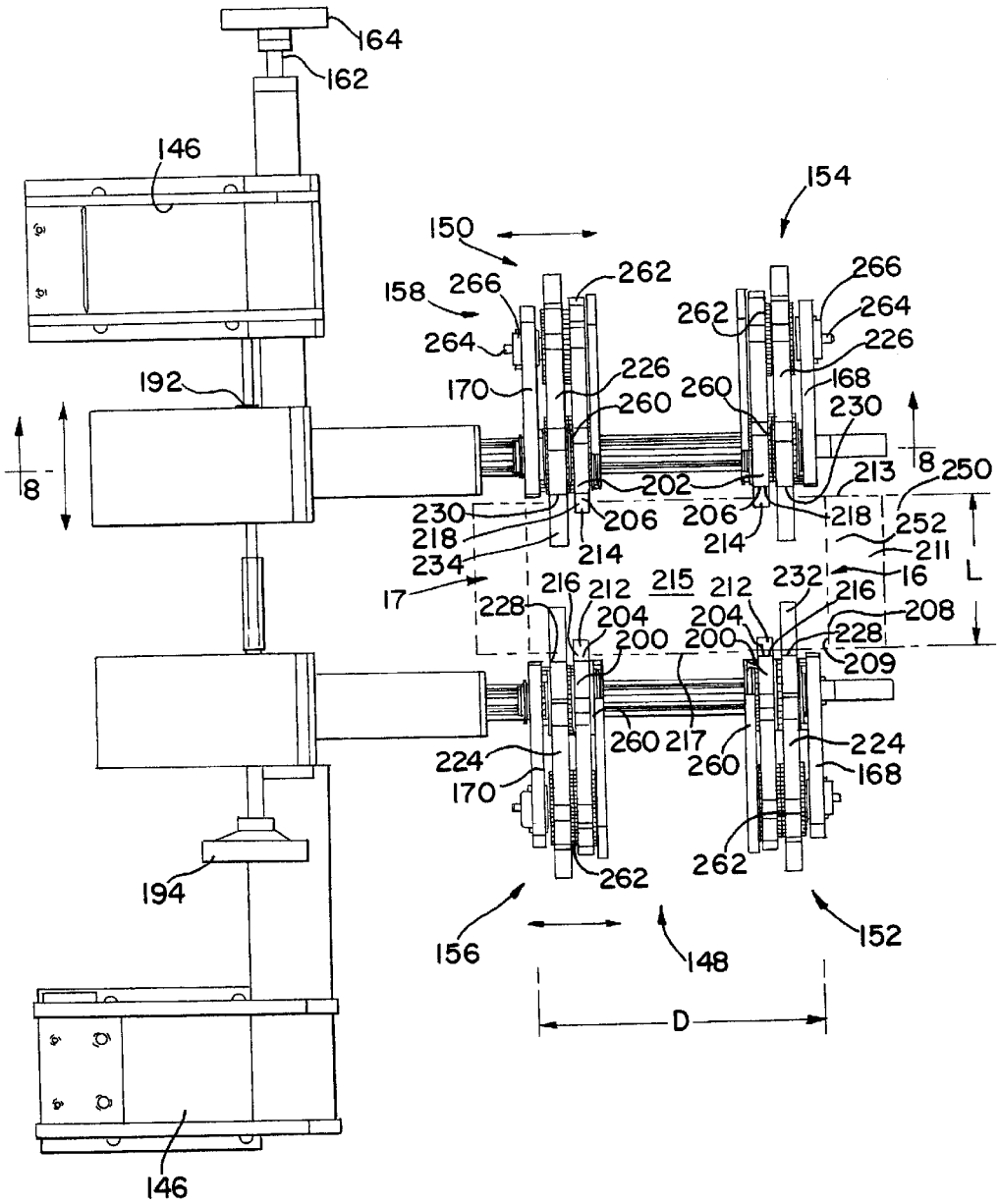
FIG. 7 is a top view of the indexer.

Referring to FIGS. 5–8, the indexer 4 includes a pair of vertically extending support frames 146 and an indexing assembly 148, 150 supported by each support frame. The first and second indexing assemblies 148, 150 are a mirror image of each other, and are assembled from the same parts, which are simply flipped 180 degrees. As shown in FIGS. 7, 9 and 10, the indexing assemblies 148, 150 are cantilevered over the conveyor with the loading side 16 facing the output end 14 of the loader 2. Each indexing assembly includes a front and rear drive assembly 152, 154, 156, 158, with the front drive assemblies 152, 154 located at the loading side 16 of the indexer. As shown in FIGS. 6 and 7, the second indexing assembly 150 is laterally, slideably supported on the support frame 146, wherein the second indexing assembly can be moved toward and away from the first indexing assembly 158. Specifically, the second indexing assembly includes a pair of horizontal support members that are slideably received in a pair of sleeves connected to the support frame 146. An actuator 160, including a shaft 162 and a wheel 164, is rotatably connected to a support member 166 secured to the second indexing assembly and threadably engages the support frame. Rotation of the actuator causes the second indexing assembly 150 to move toward and/or away from the first indexing assembly, which is preferably fixed. It should be understood that the first indexing assembly also could be made moveably, laterally adjustable.

The front and rear drive assemblies 152, 156 on the first and second indexing assemblies each include a support plate 168, 170 connected with a pair of horizontally and longitudinally extending support members 172, preferably configured as support tubes. A pair of horizontally extending drive shafts 174 are rotatably supported by the plates and are coupled to stepper motors 176 supported by a support structure 178 connected to the support frame 146. One commercially available motor suitable for this application is the Pacific Scientific model E42HLHT-CS5-NS-O2.

Figure 8:
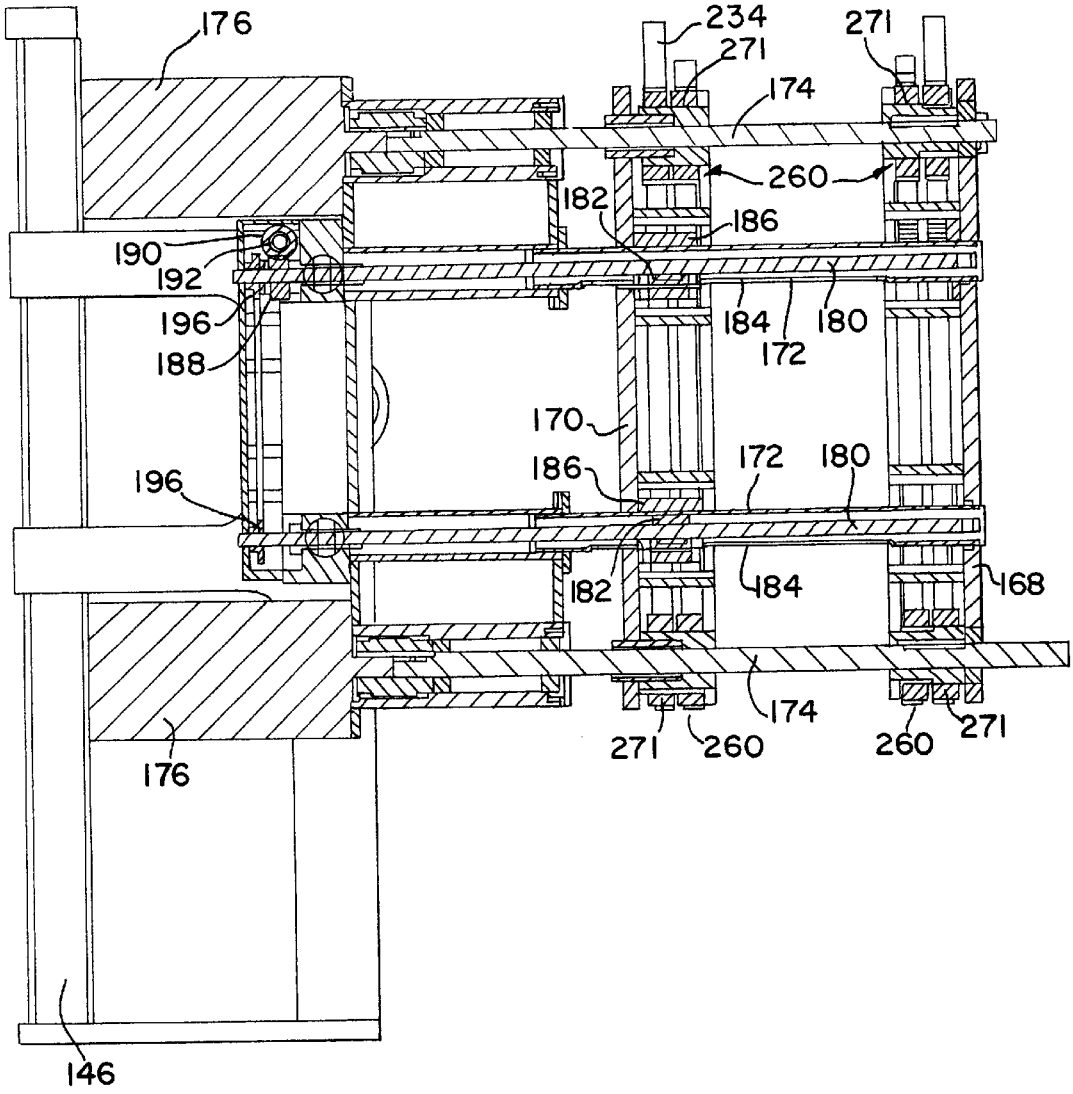
FIG. 8 is a cross-sectional view of the indexer taken along line 8—8 of FIG. 7.

Referring to FIG. 8, a shaft 180 extends longitudinally within each support member 172 and is rotatably supported by the outer support plate 168 on one end and by the support 178 on the other end. A nut 182 includes a key square, which is disposed within a slot 184 formed in the bottom of the support member 172. The nut is secured to the rear support plate 170. The nut 182 threadably engages the shaft 180. In addition, a slide member 186, which is connected, and preferably bolted, to the rear support plate, slides along the top of the support member 172 as the rear drive assembly moves toward and away from the front drive assembly on each of the right and left indexing assemblies. Preferably, the slide member is made of Delrin, or a like plastic material having a low coefficient of friction.

The end of the upper shaft 180 is configured with a gear 188 that engages a worm gear 190 formed on the end of a shaft 192. As shown in FIG. 7, the shaft 192 is rotatably connected to the first indexing assembly and extends between the first and second indexing assemblies 148, 150 so as to adjust the distance between the front and rear drive assemblies on each of the indexing assemblies. A wheel 194 is provided to rotate the shaft. In addition, each shaft 180 is configured with a sprocket 196, which are interconnected with a chain. Rotation of the shaft 192 causes the upper gear 196 and shaft 180 to rotate, which in turn rotates the chain, lower gear 196 and lower shaft 180, and thereby also causes the rear support plates 170 on each of the indexing assemblies to slide on the support members 172 toward and away from the front support plate 168 on each of the indexing assemblies. In this way, the distance between the front and rear drive assemblies 152, 154, 156, 158 on each indexing assembly can be concurrently adjusted so as to accommodate cartons having different depths, wherein the depth (D) of the carton is defined as the distance between the open ends of the carton at a score line. Carton end flaps are defined at the score line 209, with major flaps 211 extending from the front and back panels 215 of the carton and with dust (minor) flaps 213 extending from the side panels 217 of the carton. It should be understood that the front drive assemblies 152, 154 also could be made adjustable.

Each of the front and rear drive assemblies 152, 156 of the first indexing assembly 148 include a first drive member 200, while each of the front and rear drive assemblies 154, 158 on the second indexing assembly include a second drive member 202. Each drive member is preferably configured as a belt, which has been defined above. The first and second indexing assemblies are spaced apart such that the first and second drive members 200, 202 have spaced apart inwardly facing outer surfaces 204, 206, which are preferably parallel to each other along a vertical portion. Alternatively, the space between the drive members 200, 202 at the output end 20 of the indexer can be less than the space between the drive members at the input end 18, such that the cartons disposed therebetween are slightly bowed as they are moved from the input end to the output end.

Each of the first and second drive members 200, 202 include a plurality of first and second support members 212, 214 respectively, configured as support lugs, that extend laterally outward from the drive members. The first support members 212 are horizontally aligned with and extend toward the second support members 214 along the vertically extending portion 216, 218 of the first and second drive members that face each other. The vertically extending portions of the drive members, which move continuously in a loop, and the aligned support members 212, 214 extending from the vertical portion 216, 218 at any particular moment, define a loading zone 250 of the indexer, which loading zone has an input end 18 and an output end 20. The first and second support members 212, 214 located in the loading zone at any particular moment each have a substantially flat, horizontal, upwardly facing support surface 220, 222.

Each of the front and rear drive assemblies of the first indexing assembly also includes a third drive member 224, while each of the front and rear drive assemblies on the second indexing assembly also include a fourth drive member 226. Each drive member is configured as a belt, which has been defined above. The first and second indexing assemblies are spaced apart such that the third and fourth drive members have spaced apart inwardly facing outer surfaces 228, 230, which are preferably parallel to each other along a vertical portion, and which are preferably aligned with and substantially flush with the surfaces 220, 222 of the first and second drive members respectively. Alternatively, the space between the drive members at the output end of the indexer can be less than the space between the drive members at the input end, such that the cartons disposed therebetween are slightly bowed as they are moved from the input end to the output end.

Each of the third and fourth drive members 224, 226 include a plurality of third and fourth support members 232, 234, configured as support lugs, that extend laterally outward from the drive members 224, 226. The third support members 232 are horizontally aligned with and extend toward the fourth support members 234 along the vertically extending portion 236, 238 of the third and fourth drive members that face each other in the loading zone. The third and fourth support members 232, 234 located in the loading zone 250 at any particular moment each have a substantially flat, horizontal, downwardly facing support surface 240, 242.

In one embodiment, the third and fourth support members 232, 234 are preferably horizontally aligned with the first and second support members 212, 214 respectively. The upwardly facing support surfaces 220, 222 of the aligned pairs of first and second support members on each of the front and rear drive assemblies and the downwardly facing support surfaces 240, 242 of the next upper aligned pair of third and fourth support members on each of the front and rear drive assemblies define at least in part a plurality of loading stations 252 and in particular the width (W) of the loading station. Preferably, the space between the support members 212, 214, 232, 234 defining the loading station is slightly larger than the width (W) of the carton. Likewise, the outer surfaces 220, 222, 228, 230 of the first, second, third and fourth drive members along the vertical portions in the loading zone 250 define in part the plurality of loading stations 250 and in particular the length (L) of the loading stations. Preferably, the carton is squeezed slightly along its length between the drive members such that the face and back panels are slightly, outwardly bowed. In this way, a plurality of loading stations are formed in the loading zone. It should be understood that the loading station can be defined simply by one or more lower support members that are adapted to support a carton thereon, regardless of whether additional upper support members, or the drive members themselves are engaged, with the carton.

It should be understood that in an alternative embodiment the first and second drive members can be configured with successive vertically displaced lug members that define a top and bottom of the loading stations. For example, the support member can have both an upwardly facing surface that defines a lower plane of the loading station and an upwardly facing surface that defines an upper plane of a next lower loading station. In this embodiment, the third and fourth drive members may be omitted from each drive assembly. In an alternative embodiment, the loading station is defined only by the upwardly facing support surface of each pair of lug members.

Each of the front and rear drive assemblies 152, 154, 156, 158 on the each of the first and second indexing assemblies 148, 150 preferably includes three pulleys 260, 262. The inboard pulleys 260 are connected to the drive shafts 174 and engage the first, second, third and fourth drive members 200, 202, 224, 226. The outboard pulley 262 engages the first, second, third and fourth drive members, but includes a shaft 264 that is slideably mounted on the plate members 168, 170. A nut 266 can be used to clamp the shaft to the plate. The pulley 262 can be moved inboard and/or outboard to adjust the tension in the drive members, and to loosen the drive members for removal and maintenance.

In operation, the carton placer 8 moves a carton 208, which may be in a flat folded configuration, and in particular the bottom of the carton into engagement with the upper surfaces 220, 222 of a pair of first and second support members 212, 214 at the input end 18 of the loading zone. Preferably, the carton placer is a rotary carton placer having two spindles 309, each of which is capable of engaging and moving a carton from the carton magazine 9 to the input end 18 of the indexer 4. If folded, the carton may be unfolded as it engages the support members and is moved vertically downward into the loading zone at a first loading station. At the same time, the bottom surface 240, 242 of the third and fourth support members 232, 234 are brought into engagement with a top of the carton. The surfaces 240, 242 of the third and fourth support members are spaced from the surfaces 220, 222 of the first and second support members a distance substantially equal to the width (W) of the carton, which occupies and defines the loading station. At the same time, as explained above, the first and second indexing assemblies can be moved toward and away from each other such that the inwardly facing outer surfaces 204, 228 of the vertical portion of the first and third drive members are spaced from the inwardly facing outer surfaces 206, 230 of the vertical portion of the second and fourth drive members respectively a distance substantially equal to the length (L) of the carton. If a different carton size is to be run, the width (W), length (L) and depth (D) of the loading station can be easily adjusted.

For example, the distance between the first support members 212 on the first drive member and between the second support members 214 on the second drive member, or between the third support members 232 on the third drive member and between the fourth support members 234 on the fourth drive member, or both, can be adjusted to accommodate cartons having a different depths.

Preferably, however, and referring to FIG. 8, the spaces between the first, second, third and fourth support members 212, 214, 232, 234 on each of the first, second, third and fourth drive members respectively are maintained fixed. Instead, to vary or adjust the space between the first and third support members 212, 232 and between the second and fourth support members 214, 234, which define respectively the width of the loading station 252, the first, second, third and fourth drive members 200, 202, 224, 226 can be independently moved by one of the four stepper motors 176 attached to each of the drive shafts 174. For example, the upper stepper motor on the second indexing assembly 150 can be configured to move the second drive members 202 on each of the front and rear drive assemblies independently of the fourth drive members 226 by way of an idler 271 interfacing between the fourth drive members and the drive shaft 174.

Likewise, the lower stepper motor on the second indexing assembly 150 can be configured to move the fourth drive members 226 on each of the front and rear drive assemblies independently of the second drive members 202 by way of an idler 271 interfacing between the second drive members and the drive shaft 174. Of course, it should be understood that the lower stepper motor can be configured to move the second drive members and that the upper stepper motor can be configured to move the fourth drive members. Likewise, it should be understood that the stepper motors on the first indexing assembly 148 are preferably configured to independently move the first and third drive members 200, 224 by way of idlers interfacing between the drive members and the draft shafts.

Figure 11:
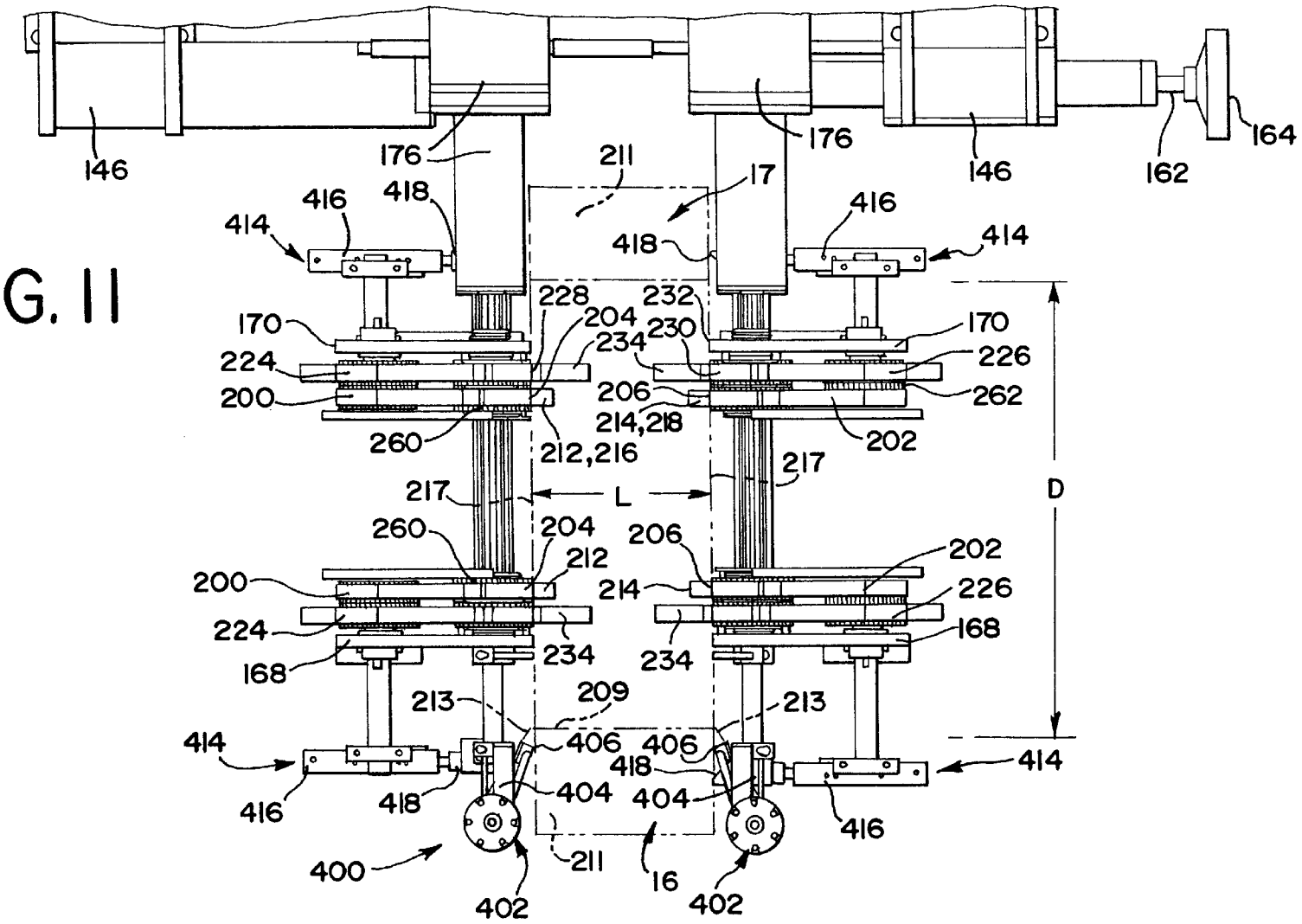
FIG. 11 is an top view of an indexer having a flap-handling device taken from the loading side thereof.
Figure 12:
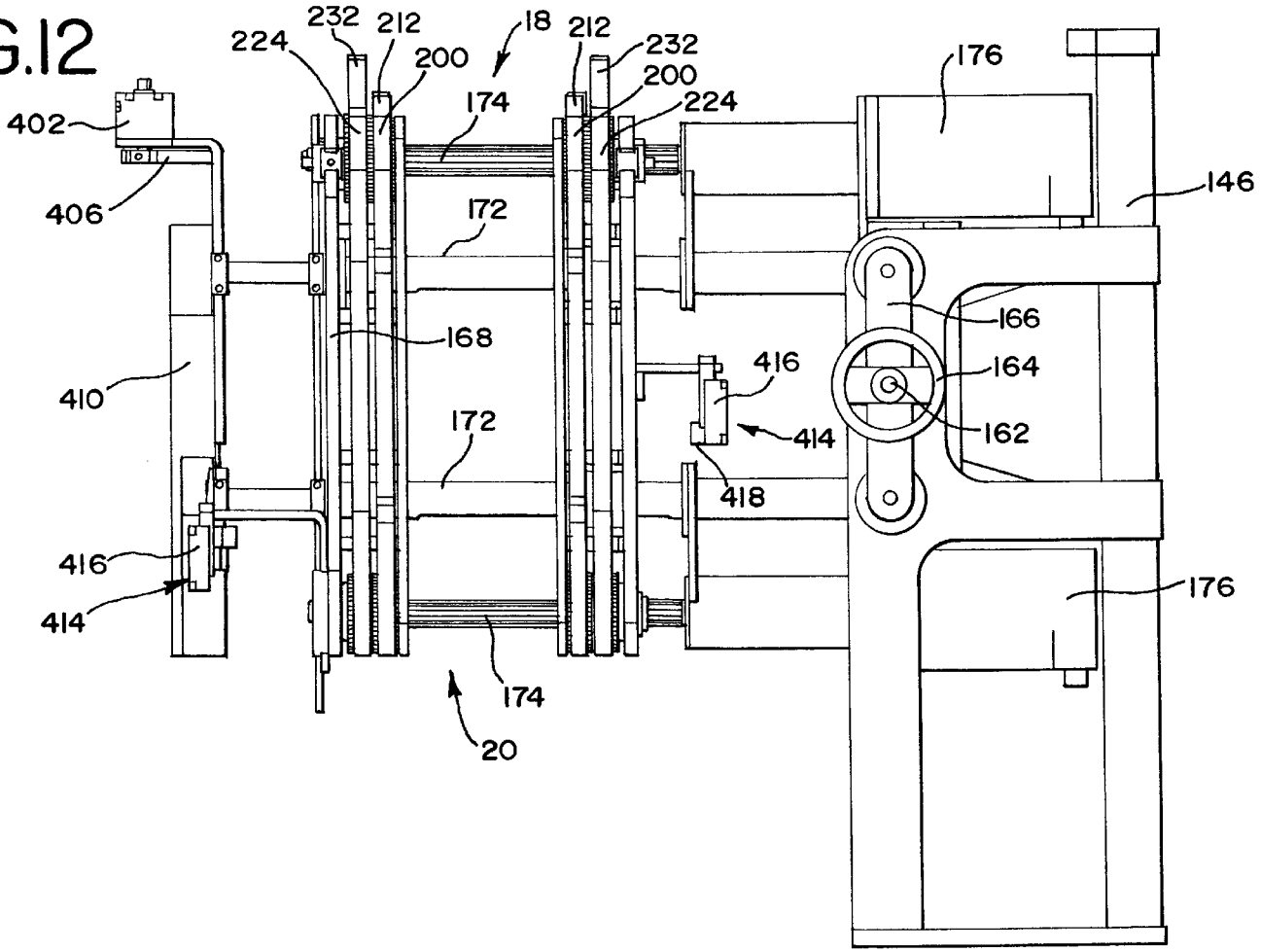
FIG. 12 is a side view of the indexer shown in FIG. 11.
Figure 13:
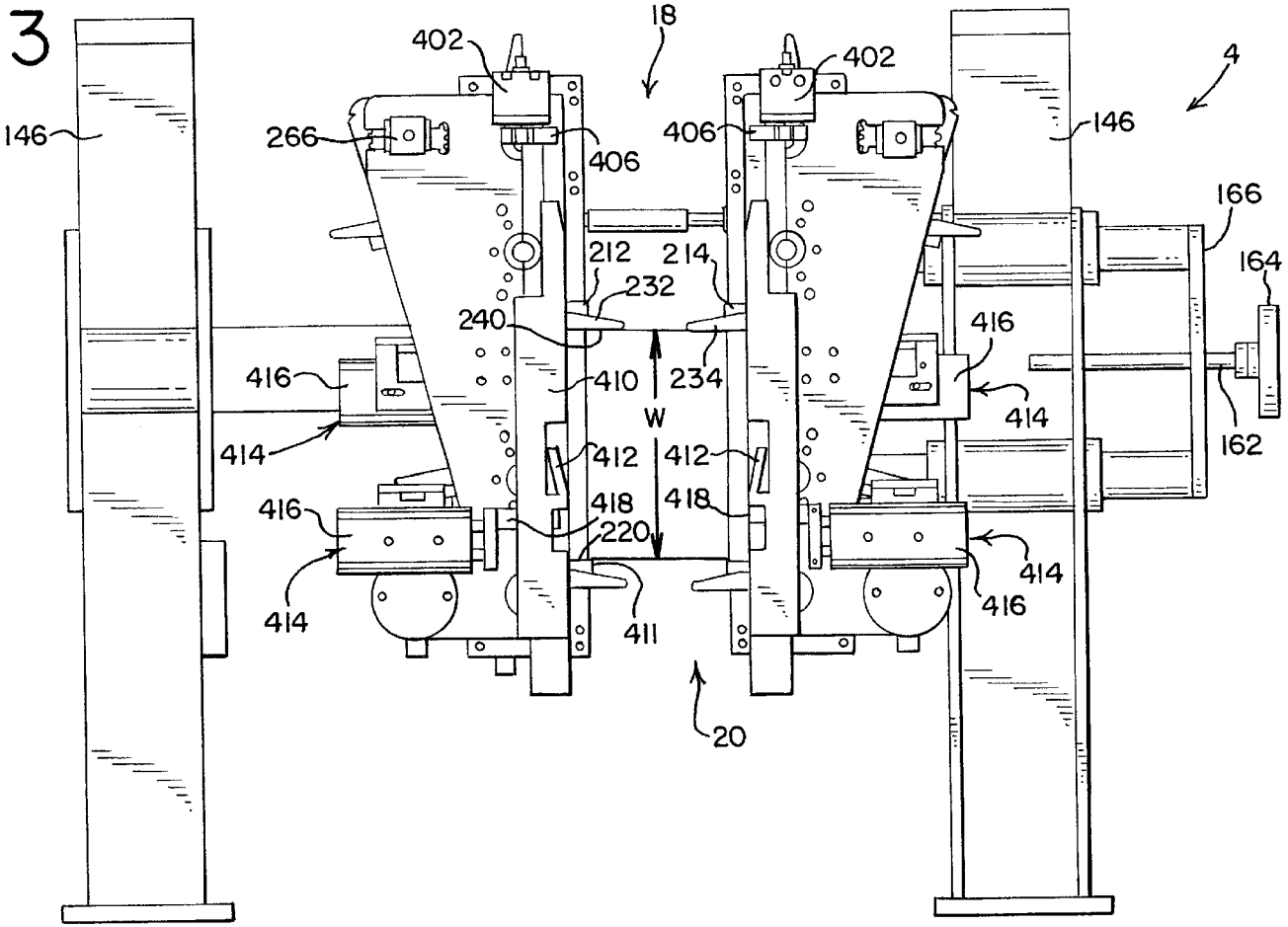
FIG. 13 is an end view of the indexer shown in FIG. 11.

Referring to FIGS. 11–13, an alternative embodiment of the indexer is shown as including a flap-handling device 400. The first and second indexing assemblies are shown as defining at least two loading stations 252, with the lower loading station defined by the first, second, third and fourth support members 212, 214, 232, 234 and with the upper loading station being only partially defined by the first and second support members 212, 214. The flap-handling device includes a pair of rotary actuators 402 mounted on a support 404 extending from the front drive assemblies on each of the first and second indexing assemblies. Each rotary actuator 402, which is shown in the closed position, includes a pivot lever or arm 406. In operation, the actuators are moved to the open position, with the lever 406 on the first indexing assembly rotated clockwise about 180 degrees from the closed position and the lever 406 on the second indexing assembly rotated counterclockwise about 180 degrees from the closed position. The carton placer then places a carton 208 into the upper loading station 252 as the carton is initially supported by the first and second support members. The rotary actuators 402 are then actuated to move the levers 406 to the closed position such that the levers engage the minor flaps 213 of the carton and break the flaps along the score lines 209 and rotate the minor flaps 213 slightly outward such that they do not interfere with the insertion of the package into the carton. The front drive assemblies support the side panels of the carton 217 as the minor flaps are initially folded along the score line. Alternatively, a guide can extend forwardly from the front drive assemblies to support the side panels of the carton, such that the carton is not ripped as the levers initially break the minor flaps. As the carton is moved downwardly in the loading zone, a guide 410 further engages the inner surface of the minor flaps and holds them away from the opening into the carton. The package is then inserted into the carton. The carton is then further lowered in the loading zone until the bottom edge 411 of the flaps engage an upwardly and rearwardly extending tab 412 connected to the guide member, which forces the minor flaps inwardly so as to initiate the folding or closing process.

A pair of linear actuators 414 are further connected to a lower portion of each the first and second indexing assemblies. Each linear acutator includes a pneumatic actuator 416 and a push member 418, which preferably includes a beveled or angled surface that initially engages the outer surface of the minor flaps. Alternatively, it should be understood that the actuator can be mechanical or hydraulic. The linear actuators are actuated such that the push members 418 are moved horizontally and laterally inwardly such that they engage an outer surface of the minor flaps as they are initially folded inwardly by the tab members 412. The push members further fold the minor flaps over the opening to the carton. The lower major flap 211 is then engaged by a guide 424, which pushes it upwardly and folds it over the minor flaps. The guide is preferably secured to the conveyor or other structure positioned beneath the indexer. The minor and major flaps are then glued, and the upper major flap folded in the closer as the conveyor transports the carton away from the indexer.

A pair of linear actuators 414 are also connected to the rear drive assemblies. Each linear actuator includes a pneumatic actuator 416 and a push member 418. Each linear actuator is actuated, preferably concurrently, such that the push members are moved horizontally and laterally inwardly such that they engage an outer surface of the rear minor flaps 213 and break the flaps along the score line to fold the minor flaps inwardly over the rear carton opening. The rear drive assemblies support the side panels of the carton as the minor flaps are folded along the score line. Alternatively, a guide can extend rearwardly from the rear drive assemblies to support the side panels of the carton, such that the carton is not ripped as the push members initially break or fold the minor flaps. The push members 418 hold the minor flaps closed while the package is inserted into the carton and thereby provide a backstop for the package. Accordingly, the linear actuators 414 connected to the rear drive assemblies are positioned above the linear actuators connected to the front drive assemblies and above the tab members, and are preferably in approximate alignment with the output end of the loader. The lower major flap can then be engaged by a guide, which pushes it upwardly and folds it over the minor flaps. The guide is preferably secured to the conveyor or other structure positioned beneath the indexer. The minor and major flaps are then glued, and the upper major flap folded in the closer as the conveyor transports the carton away from the indexer.

In operation, if a line change is desired, wherein a package having a greater or lesser width will be run, the upper and/or lower stepper motors on each of the first and second indexing assemblies 148, 150 can be actuated to move the first and second support members 212, 214 toward or away from the third and fourth support members 232, 234 without the need to individually remove and reattach the support members to the drive members. As shown in FIGS. 5–13, for example, the maximum width of the loading station is defined, with the first and second support members 212, 214 being substantially aligned with the third and fourth support members 232, 234. In this way, the indexer can be adjusted virtually instantaneously to redefine in part the size or depth of the loading stations so as to accommodate a new carton. Likewise, the second indexing assembly 150 can be moved toward or away from the first indexing assembly 148 to alter the length of the loading station. In addition, if it is desired to have the first and third support members 212, 232 positioned slightly lower or higher than the second and fourth support members 214, 234 at each loading station, for example to aid in the reception and unfolding of the carton as it is introduced into a loading station by having one corner of the carton positioned slightly lower as it progresses through the indexer, the stepper motors on one or both of the first and second indexing assemblies can be actuated simultaneously to move the associated drive members with the attached support members to the desired position. Preferably, once the depth, length and width of the loading stations are defined, the stepper motors act in unison to move the first, second, third and fourth drive members together during the normal operation of the indexer so as to successively align successive cartons with the output end 14 and the horizontal path of the loader. It should also be understood that the movement of the various drive members could be effected by way of other interfacing mechanical arrangements, including for example various gear boxes, drive shafts and pulleys.

As the loading stations 252, and cartons 208 positioned therein, are moved vertically by the motors 176, drive shafts 174 and drive members, they are successively brought into alignment with the output end 14 of the loader. At that point, the first, second, third and fourth drive members, and their corresponding support members, are temporarily stopped. At the same time, one or more packages are introduced by the package feed into the input end 12 of the loader, which shapes and moves the package(s) toward the output end 14, whereinafter the loader inserts the one or more packages into the carton positioned in the loading station 252 aligned with the output end 14. The carton preferably has at least one open end facing the output end of the loader that is shaped to receive the package(s). The drive members are then moved another interval to put the next loading station 252 into alignment with the output end 14 of the loader, which again inserts a package into the carton, and so on.

Alternatively, a first set of one or more packages can be inserted into a carton having a volume adapted to receive additional packages. After the first set is inserted into the carton, the indexer moves an amount to align the remaining empty space in the carton with the output end of the loader, whereinafter a second set of one or more packages is inserted into the carton. It should be understood that a plurality of sets of packages can be inserted into the carton in this way.

It should be understood that the loading zone 250 of the indexer can be configured with any number of loading stations 252 and that the three loading stations shown in FIGS. 5–9 or the two loading stations shown in FIGS. 11–13, are meant to be illustrative rather than limiting. For example, the indexer could be configured with a single loading station. It also should be understood that the output end 14 of the loader can be aligned with any one of the loading stations, and in one embodiment is preferably aligned with the lowermost loading station.

In one embodiment, a premium 270, which is defined as any object other than the package, including for example and without limitation CD's, trinkets, toys, coupons, and the like, can be easily inserted into the carton, either before or after the package has been inserted, and preferably before the package is inserted into the carton. For example, the premium can be inserted into the carton at a loading station positioned above or below the loading station aligned with the loader. The premium can be inserted at the same time as the package while the carton is temporarily stopped. In one preferred embodiment, the premium is inserted with a premium inserter positioned adjacent the indexer. Suitable premium inserters are commercially available from Longford International.

After the package is inserted into the carton, the indexer, which operates intermittently to permit the package to be inserted into the carton, releases the carton and package from the output end 20 and deposits them onto a conveyor 22, which should be understood to mean any device configured for moving an object, including for example and without limitation, a belt, chains and lugs, rollers etc. The package can then be carried by the conveyor 22 to a closer 6 to finish closing the carton. The carton and package can be deposited onto a continuously moving conveyor, or an intermittently moving conveyor, which is temporarily stopped beneath the indexer while the carton is deposited onto the conveyor. In one embodiment, wherein the conveyor moves intermittently, a plurality of packages can be stacked one on top of the other at a single station on the conveyor, which remains stationary under the output end of the indexer for a plurality of cycles of the indexer. The conveyor may include lugs that engage and propel the carton(s).

It should be understood that various sensors and control systems, which are well known in the art, including for example various PLC's, can be configured to sequence the loader, carton placer, premium inserter, indexer and/or conveyor. In this way, the speed of the carton placer, indexer and loader are coordinated, wherein the carton placer positions a carton into each loading station in the indexer at the same time the loader is inserting a package into a carton or the premium inserter is inserting a premium at a lower loading station.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A horizontal cartoner assembly for inserting a package into a carton comprising:

a loader comprising at least one horizontally extending drive belt adapted to support a package, wherein said loader has an input end and an output end, wherein said at least one drive belt comprises a first horizontally extending drive belt and a second horizontally extending drive belt spaced from said first drive belt in a substantially parallel relationship; and an indexer positioned adjacent said output end of said loader and comprising a plurality of moveable support members defining at least in part a plurality of loading stations, wherein said support members are adapted to support a carton at each of said loading stations, and wherein said support members are moveable such that said plurality of loading stations are successively aligned with said drive belt of said loader at said output end of said loader.

2. The invention of claim 1 wherein said support members are moveable in a vertical direction.

3. The invention of claim 1 wherein said support members are intermittently moveable, such that each of said plurality of loading stations are intermittently stationary as said loading station is aligned with said drive belt at said output end of said loader.

4. The invention of claim 1 wherein at least one of said first and second drive belts are moveable toward and away from the other of said first and second drive belts, wherein the space between said first and second drive belts can be varied.

5. The invention of claim 1 wherein said loader further comprises third and fourth horizontally extending drive belts oriented in a substantially perpendicular relationship with said first and second drive belts, and wherein said third drive belt is spaced from said fourth drive belt in a substantially parallel relationship.

6. The invention of claim 5 wherein at least one of said third and fourth drive belts is moveable toward and away from the other of said third and fourth drive belts, wherein the space between said third and fourth drive belts can be varied.

7. The invention of claim 5 wherein said first, second, third and fourth drive belts are operably connected such that said first, second, third and fourth drive belts move at the same speed.

8. The invention of claim 7 wherein said loader comprises a motor operably connected to said first, second, third and fourth drive belts.

9. The invention of claim 1 wherein said indexer has an input end and an output end, and further comprising a carton placer positioned adjacent said input end of said indexer and adapted to position a carton in each of said plurality of loading stations.

10. The invention of claim 9 wherein said carton placer is a rotary carton placer.

11. The invention of claim 1 wherein said indexer has an input end wherein said indexer is adapted to receive said cartons and an output end wherein said indexer is adapted to release said cartons, and further comprising a continuously moving conveyor positioned adjacent said output end of said indexer.

12. The invention of claim 11 comprising a plurality of said loaders and a corresponding plurality of indexers associated with said plurality of loaders, and wherein said output ends of said plurality of indexers are successively aligned with said conveyor.

13. The invention of claim 1 wherein said at least one drive belt moves at a constant speed.

14. A horizontal cartoner assembly for inserting a package into a carton comprising:

a loader comprising at least one horizontally extending drive belt adapted to support a package, wherein said loader has an input end and an output end; and an indexer positioned adjacent said output end of said loader and comprising a plurality of moveable support members defining at least in part a plurality of loading stations, wherein said support members are adapted to support a carton at each of said loading stations, and wherein said support members are moveable such that said plurality of loading stations are successively aligned with said drive belt of said loader at said output end of said loader, wherein said indexer comprises a first and second drive member, wherein said first and second drive members are spaced apart and each comprise a plurality of said support members extending therefrom, wherein said plurality of support members on said first and second drive members extend toward each other and are aligned to define at least a portion of said plurality of loading stations.

15. The invention of claim 14 wherein at least one of said first and second drive members is moveable toward and away from the other of said first and second drive member, wherein the space between said first and second drive members can be varied.

16. The invention of claim 15 further comprising a third and fourth drive member, wherein said third drive member is substantially aligned with said first drive member and wherein said fourth drive member is substantially aligned with said second drive member, wherein said third and fourth drive members are spaced apart, and wherein said plurality of support members connected to said first and second drive members comprises a plurality of first lug members, and wherein said third and fourth drive members comprise a plurality of aligned second lug members extending toward each other, and wherein said plurality of said first and second lug members define a plurality of pairs of spaced apart first and second lug members defining said plurality of stations therebetween.

17. The invention of claim 16 wherein at least one of said first and second lug members in each of said pairs of said first and second lug members are moveable toward and away from the other of said first and second lug members in each of said pairs of said first and second lug members.

18. The invention of claim 14 wherein said at least one drive belt moves at a constant speed.

19. A horizontal cartoner comprising:

an indexer comprising:

first and second spaced apart drive members, wherein each of said first and second drive members have at least a substantially vertically extending portion arranged in a substantially parallel relationship, and a plurality of lower support members extending from each of said first and second drive members toward the other of said first and second drive members, wherein said plurality of lower support members on each of said first and second drive members are in general horizontal alignment so as to thereby define a plurality of horizontally aligned pairs of lower support members adapted to support a carton, and wherein at least a portion of said first and second drive belts are moveable in a vertical direction; and third and fourth drive members, wherein said third drive member is substantially aligned with said first drive member and wherein said fourth drive member is substantially aligned with said second drive member, wherein said third and fourth drive members are spaced apart, wherein said third and fourth drive members comprise a plurality of aligned upper support members extending toward each other, and wherein said plurality of aligned lower support members on said first and second drive members and said plurality of aligned upper support members on said third and fourth drive members define a plurality of pairs of spaced apart lower and upper support members defining a plurality of loading stations therebetween.

20. The invention of claim 19 wherein at least one of said first and second drive members is horizontally moveable toward and away from the other of said first and second drive members, wherein the space between said first and second drive members can be varied, and wherein at least one of said third and fourth drive members is horizontally moveable toward and away from the other of said third and fourth drive members, wherein the space between said third and fourth drive members can be varied.

21. The invention of claim 19 wherein said first, second, third and fourth drive members are independently moveable.

22. The invention of claim 19 wherein said indexer further comprises a rotary actuator comprising a lever, wherein said lever is adapted to engage a flap of the carton.

23. The invention of claim 19 wherein said indexer further comprises a vertically extending guide positioned adjacent said rotary actuator, wherein said guide is adapted to engage a flap of the carton.

24. The invention of claim 23 wherein said guide comprises a tab.

25. The invention of claim 19 wherein said indexer further comprises an actuator comprising a push member adapted to engage a flap of the carton.

26. The invention of claim 25 wherein said actuator is positioned on a loading side of said indexer.

27. The invention of claim 25 wherein said actuator is positioned on a backstop side of said indexer.

* * * * *